United States Patent [19]

States et al.

[11] Patent Number: 4,548,840

[45] Date of Patent: Oct. 22, 1985

[54] HIGH SPEED COATING

[75] Inventors: Kenneth H. States; Walter W. Smith, both of Graham, Tex.

[73] Assignee: Graham Magnetics Incorporated, North Richland Hills, Tex.

[21] Appl. No.: 608,891

[22] Filed: Jun. 15, 1984

[51] Int. Cl.[4] ..... B05D 1/28; B05D 3/12; B05C 3/02

[52] U.S. Cl. ..... 427/365; 118/249; 118/258; 118/259; 118/261; 118/407; 118/413; 427/428

[58] Field of Search ..... 427/346, 356, 358, 359, 427/361, 365, 428; 118/249, 258, 259, 261, 407, 413

[56] References Cited

U.S. PATENT DOCUMENTS

| | | | |
|---|---|---|---|
| 3,081,191 | 3/1963 | Smith et al. | 118/413 X |
| 4,245,583 | 1/1981 | Schollkopf et al. | 118/259 |
| 4,345,543 | 8/1982 | Pipkin | 118/413 X |
| 4,400,953 | 8/1983 | Driessen et al. | 118/261 X |
| 4,442,144 | 4/1984 | Pipkin | 118/413 X |
| 4,475,478 | 10/1984 | Berdinner et al. | 118/413 |

FOREIGN PATENT DOCUMENTS

| | | | |
|---|---|---|---|
| 2425277 | 1/1980 | France | 118/261 |

*Primary Examiner*—Michael R. Lusignan
*Attorney, Agent, or Firm*—Andrew F. Kehoe

[57] ABSTRACT

Novel coating apparatus and method whereby a coating transfer roll is utilized as part of the coating composition reservoir and kinetic energy from said roll is a principal and effective means to keep the coating composition effectively agitated.

19 Claims, 2 Drawing Figures

HIGH SPEED COATING

BACKGROUND OF THE INVENTION

This invention relates to improved systems for applying liquid coatings to sheet products, particularly with the use of a transfer roll intermediate a coating reservoir and the sheet to be coated.

A substantial amount of attention has been given to improving coating processes over recent years. Whether for improvements in greater coating uniformity, in thinner coatings, or in achieving more severe processing conditions, there has been an increased amount of interest in this area of art. For example U.S. Pat. No. 4,387,124 describes a coating apparatus using a geometrical flow-divider to aid the distribution of a non-Newtonian fluid onto a web while a resilient seal means was used to maintain a small amount of liquid coating close to the web being coated: U.S. Pat. No. 3,533,833 also discloses a somewhat similar apparatus wherein a coating is applied directly to a web from a reservoir.

Neither of the above-described coating systems take advantage of a transfer-roll metering member and each utilize rather difficult-to-clean apparatus.

In many applications use of a transfer roll is desirable. Nevertheless, there have been serious drawbacks to using such a roll when the coating is to be very thin and when the roll is to be used at high speed. For example, there has been, in addition to the problem of maintaining excellent uniformity of the coating carried by the transfer roll, the problem of avoiding premature drying of the coating on the roll. All of this must be accomplished while metering a uniformlymixed coating fluid across on economically-suitable width of web to be coated.

It is the solution of such problems and allied problems that work leading to the present invention was undertaken.

SUMMARY OF THE INVENTION

It is a principal object of the invention to provide a superior process and apparatus for uniform coating of sheets.

It is a particular object of the invention to provide a superior system for coating thin webs at high coating-line speeds, e.g. up to several hundred feet or higher per minute.

Another object of the invention is to provide an improved system for applying very thin coatings (say, of the order of about 100 microinch, or 2 to 3 micrometers of dry coating) and, more particularly, thin coatings comprising volatile liquids.

Further objects of the invention are to provide a simple, and effective mixing capability in the reservoir of a coating system.

Another object of the invention is to provide a coating system that is maintained in an easily cleanable condition.

Other objects of the invention will be obvious to those skilled in the art upon their reading of this disclosure.

The above objects have been substantially achieved by providing a coating reservoir which, among other things, utilizes as one wall thereof, a moving object to be coated as a major source of kinetic energy to impart a uniform mixing energy across the entire width of the reservoir. This feature avoids the need to provide complex flow-distributing means.

Enclosed within an enclosure, or cover, of the reservoir is a doctor blade which is used to scrape off coating from that portion of the reservoir wall which has been coated and moves upwardly out of the coating liquid. Coating fluid dropping back into the reservoir further aids the aforesaid mixing action.

In preferred modes of the invention, the reservoir will be formed of a rotating transfer roll which, after the proper amount of coating is applied thereto, transfers coating to a web to be coated.

Among the advantages by the coating system of the invention is that it allows, the coating composition to be transferred on a transfer roll to a film to be coated without any degradation to the coating caused by excessive localized concentration of the film during its transit from reservoir to the surface to be ultimately coated. This is true even at very high coating-line speeds; even when using rather volatile solvents as coating composition vehicle; and even with very thin coatings being carried on the transfer drum.

In practice, the dwell time of doctored coating on the transfer roll less than about 0.5 second before it is tranferred to the ultimate web—after a web of a biaxially oriented film material such as the polyethylene terephthalate film sold by E.I. DuPont unde the name Mylar. Often, however, the dwell time is as low as 0.1 second. In any event, it has been found that, when the apparatus of the invention is used, the short dwell times effectively offset any harmful effects of increased mass transfer caused by relative speed of the coating through the environment.

It is desirable that a surface initially to be coated, i.e. that surface forming part of the coating reservoir (usually, a transfer roll) is preferably moving upwardly and pulling coating with it. Moreover, in more favorable embodiments of the invention, the roll surface has a vector moving inwardly towards the back of the reservoir, i.e. the wall of the reservoir opposed to the moving wall formed by the transfer roll. This is achieved by placing the coating reservoir below the horizontal diameter of the transfer roll being coated. Such an arrangement grossly simplifies the seal design of the reservoir. In practice, light syrup-like coatings can be used with clearances as low as about 0.005–0.010 inch between a drum and the reservoir structure. Such a clearance probably would not be suitable for holding a liquid like ethyl alcohol at the contemplated roll speeds, but it is entirely suitable for handling the types of coatings used in many applications including, for example, those used in the magnetic recording art and wherein iron oxide particles are suspended in an inorganic carrier. It will be understood that the thixotropic compositions will offer a particularly advantageous combination of properties in that they allow good mixing and also, allow better sealing away from more highly agitated portions of the reservoir.

The term "coating reservoir" as used in this application is meant to describe a container holding a substantial supply of liquid coating solution enclosed therein. That term is not intended to describe a mere nip between a surface to be coated and a feed device in which a bead of liquid resides briefly before being carried away on a coated surface. A typical contact perimeter between the transfer roll and the reservoir liquid is about two to five inches high and as wide as the coated surface, say about two to four feet. In general, it is preferred that the contact height exceed the average dimension of the reservoir extending from the transfer roll, through the liquid, to the rear wall of the reservoir most remote from the tranfer roll. Such dimensional relationships facilitate the degree of mixing in the reservoir.

The transfer roll conveniently has a surface which is slightly textured as is known to the gravure-art roll and which promotes the distribution of ultra-thin coatings.

It is preferred to operate this system under a nitrogen purge. Although such purge systems are not new, in the present systems, it has the advantage of assuring that the continuous operation of the equipment may be achieved without any concern for waste or the quality of recycled material. In the most advantageous embodiments, the nitrogen carries a substantial quantity of solvent to further avoid an evaporation of solvent in the system. There is no need for recycling material to and from the reservoir during operation. Fresh coating solution, when needed, is pumped into the reservoir in response to a constant-level control system like. It has been found desirable to have a variable level control system, i.e. one which can be utilized to set a wide range of desirable "mixing perimeters" between coating solution and roll by varying the height of the solution in the reservoir.

The advantages of the present invention become most evident when it is considered that the process is operated at from 200 to 1000 feet, or more, per minute, that a typical coating is only about 100 microinches thick, when dried, and that solvents such as dimethylformamide, tetrahydrafuran and other such solvents are commonly used as diluents and coating vehicles to maintain viscosities of 1000 centipoises, or even lower, during the coating operation.

ILLUSTRATIVE EMBODIMENT OF THE INVENTION

In this application and accompanying drawings, there is shown and described a preferred embodiment of the invention but it is to be understood that it is not intended to be exhaustive and that other changes and modifications can be made within the scope of the invention. The illustrated embodiment herein is selected and included for the purposes of illustration in order that others skilled in the art will more fully understand the invention and the principles thereof and will be able to modify it and embody it in a variety of forms, each as may be best suited to the condition of a particular case.

IN THE DRAWINGS

Figure 1:
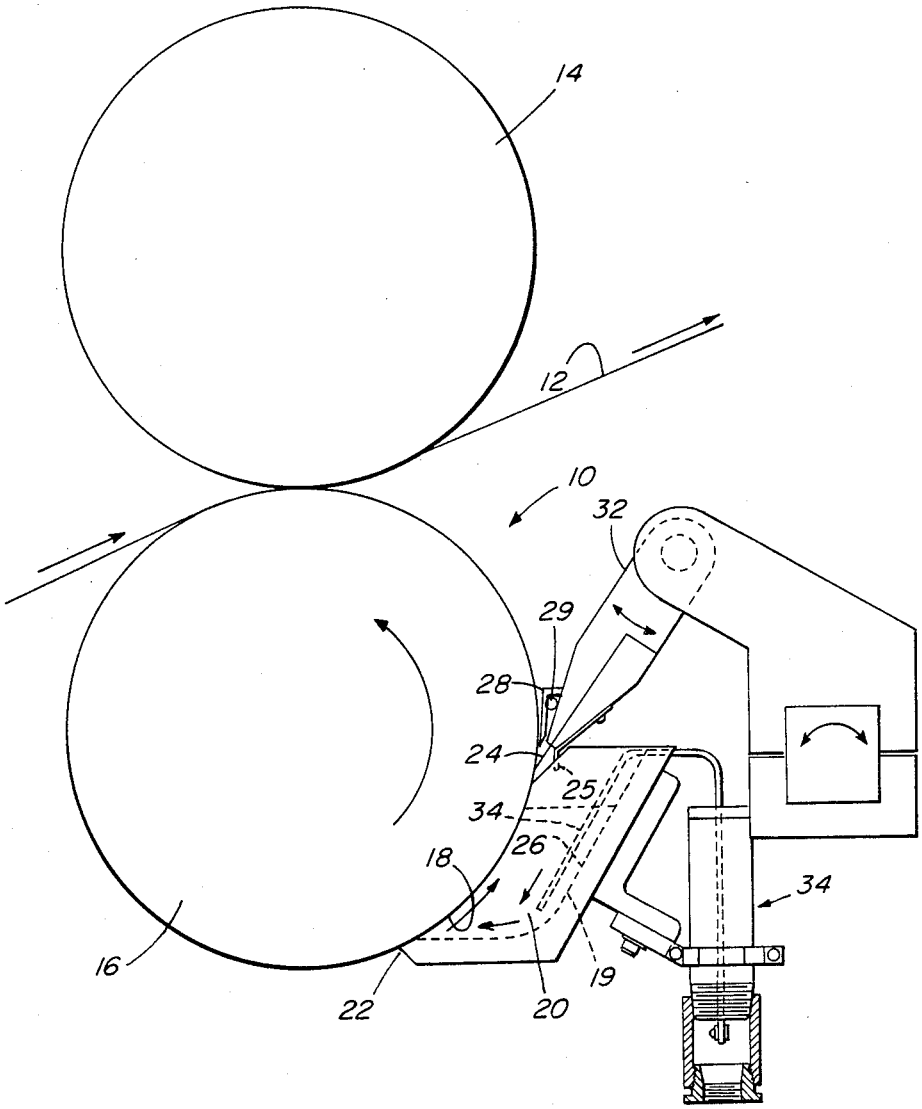
FIG. 1 is an elevation, somewhat schematic which shows the essentials of the coating system of the invention.
Figure 2:
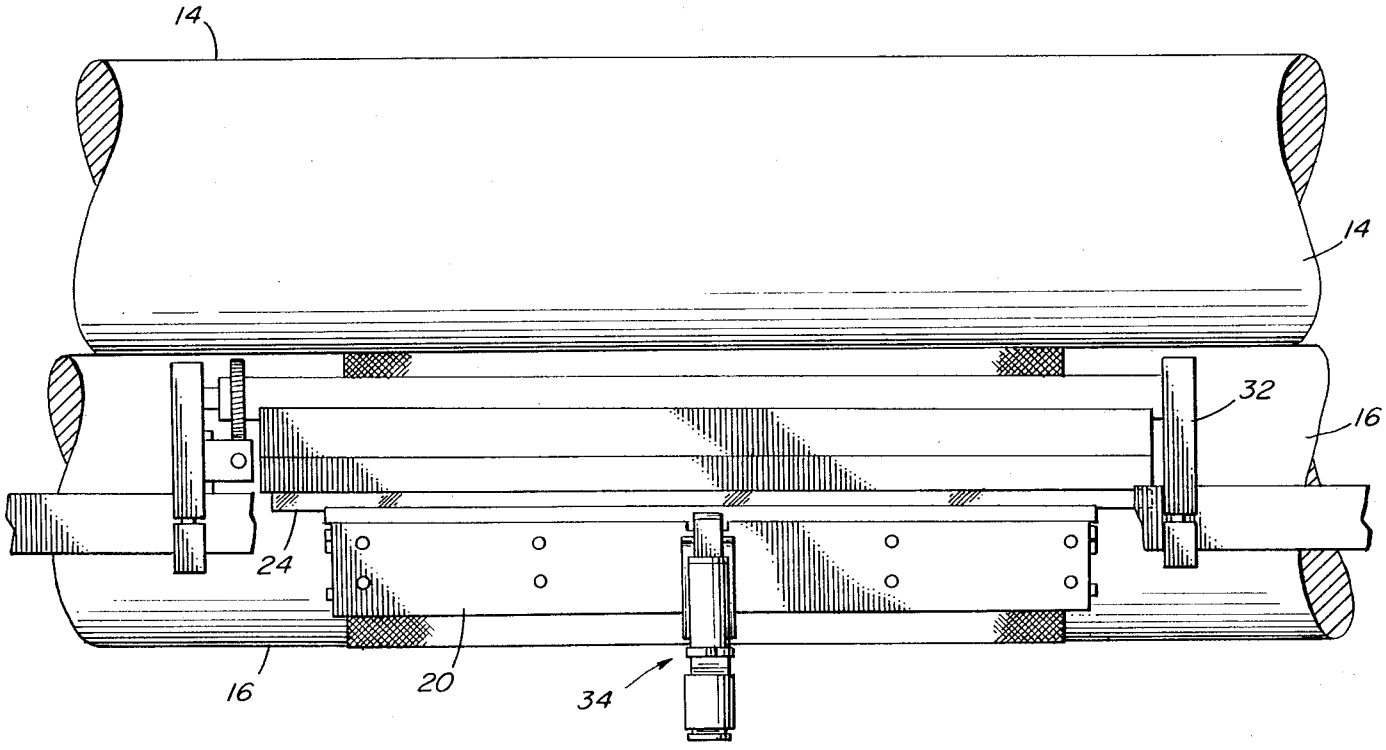
FIG. 2 is an elevation, somewhat schematic, taken at right angles to FIG. 1.

Referring to FIG. 1, it is seen that a portion 10 of a web-coating line comprises a web 12 being coated while being held by a rotating backing roll 14 against a transfer roll 16. Transfer roll 16 forms one wall 18 of a reservoir 20. Wall 18 will be seen to be constantly moving up and towards the rear wall structure 19 of the reservoir 20, thereby forming means to constantly pull a substantial portion of coating solution upwardly along its face and aid in circulating the coating solution. Simultaneous, a vector of the circulating force is directed towards the back of the reservoir.

In many useful coating applications a clearance of between 0.003 and 0.010 inches between roll 16 and reservoir 20 (e.g. at 22) is adequate. A clearance of 0.007 inches is quite versatile.

Liquid will be carried upwardly on wall 18 in quantities of, typically, 2 to 5 times the amount of coating liquid that is actually required for coating. The excess liquid is removed by a coating knife 24 and a deflector blade 25. It falls into the reservoir 20, preferably into that part of the reservoir wherein there is an upward pull on the liquid being exerted by the moving wall. It thereby contributes further to the agitation and mixing therein.

The average vertical distance of the reservoir, i.e. the contact height of liquid and moving wall 18, exceeds the average distance between the moving wall 18 and the backward wall 26. This assures mixing throughout the reservoir.

Also desirable in the apparatus of the invention if the provision of a inert-gas purge means 28 such as an elongate conduit 29. The purge is convenient nitrogen and it is recommended that it contain with a substantial amount of vapor of the more volatile solvent components of the coating solution. This purge is placed between roll 16 and the doctor blade-carrying structure 32. It is further noted that the entire structure shown is preferably enclosed within a sheet metal hood and this hood, too, is purged with a positive-pressure inert-gas bearing sufficient solvent vapor to eliminate any drying and crusting of composition anywhere on the apparatus.

Shown schematically at 34 is a capacitance-resistance-type level detector (proximity detector). Its probe 36 is placed in the reservoir. This type of level detector, a type well known in the art, allows the apparatus to be run at different liquid heights. Conduits and pumps for filling the reservoir in response to the level-control system are not shown because they form no part of the invention and are readily understood by any skilled in the art.

It is also to be understood that the following claims are intended to cover all of the generic and specific features of the invention herein described and all statements of the scope of the invention which might be said to fall therebetween.

What is claimed is:

1. Coating apparatus comprising a reservoir forming means to hold a liquid coating formulation, one wall of said reservoir being a surface of a material to be coated, said moving wall forming principal means to impart agitation to said coating formulation in said reservoir; wherein said wall of said reservoir forms means to carry some of said liquid coating in opposition to gravity, and wherein said wall is positioned sufficiently close to said reservoir structure that it forms a moving seal means with the bottom of said reservoir.

2. Apparatus as defined in claim 1 wherein said moving wall is a textured coating-transfer roll.

3. Apparatus as defined in claim 1 wherein said reservoir comprised variable liquid-level control means to provide said liquid maintains a contact height of coating liquid against said moving wall of at least about two inches.

4. Apparatus as defined in claim 2 wherein said reservoir comprised liquid-level control means to provide said liquid maintains a contact height of coating liquid against said moving wall of at least about two inches.

5. Apparatus as defined in claim 3 wherein said contact height exceeds a dimension of said reservoir from said moving wall to an opposed back wall of the reservoir most removed from said moving wall.

6. Apparatus as defined in claim 4 wherein said contact height exceeds a dimension of said reservoir from said moving wall to an opposed back wall of the reservoir most removed from said moving wall.

7. Apparatus as defined in claim 1, wherein a doctor blade, positioned near the top of said reservoir, forms means to augment agitation of said coating composition by directing coating composition doctored from said transfer roll to fall back into said reservoir.

8. Apparatus as defined in claim 2, wherein a doctor blade, positioned near the top of said reservoir, said doctor blade forms means to augment agitation of said coating composition by returning doctored coating composition into that part of the coating composition being carried upwardly, in said reservoir, by said transfer roll.

9. Apparatus as defined in claim 6, wherein a doctor blade, positioned near the top of said reservoir, said doctor blade forms means to augment agitation of said coating composition by returning doctored coating composition into that part of the coating composition being carried upwardly, in said reservoir, by said transfer roll.

10. Apparatus as defined in claim 4 wherein said reservoir is placed below the horizontal diameter of a transfer roll which forms said moving wall.

11. A process for high-speed coating a continuous web substrate with a thin coating of a liquid coating composition wherein said coating composition comprises a volatile solvent, said process comprising (a) holding said coating composition in an elongate reservoir (b) rotating said first surface to be coated upwardly while it bears against said coating composition and forms one wall of said reservoir (c) agitating said coating composition along the entire upwardly-rotating side of said reservoir, thereby to achieve effective mixing of said coating (d) transferring said coating onto a second surface within about 0.5 seconds after said first surface leaves the coating reservoir.

12. A process as defined in claim 11 comprising the step of doctoring said coating applied to said first surface to a thickness of less than about 200 microinches.

13. A process as defined in claim 11 wherein said first surface is moved at least about 300 feet per minute.

14. A process as defined in claim 11 wherein upward movement of said first surface counteracts a tendency of coating composition to leak from said reservoir.

15. A process as defined in claim 12 wherein said first surface is moved at least about 300 feet per minute.

16. A process as defined in claim 13 wherein upward movement of said first surface with respect to said reservoir counteracts a tendency of coating composition to leak from said reservoir.

17. Apparatus as defined in claim 3 wherein said moving wall is a textured coating-transfer roll.

18. Apparatus as defined in claim 2 wherein said reservoir is positioned below the horizontal diameter of said coating transfer roll.

19. A process as defined in claim 11 wherein said first surface is a coating transfer roll and wherein while it bears against said coating composition is carried out below the horizontal diameter of said transfer wall.

* * * * *